United States Patent [19]

Bakewell et al.

[11] 4,412,503

[45] Nov. 1, 1983

[54] SINKER ASSEMBLY FOR HOT-DIP COATING APPLICATIONS

[75] Inventors: Frank W. Bakewell, Apollo; Thomas E. Nicely, Delmont; C. Donald Stricker, Monroeville, all of Pa.

[73] Assignee: United States Steel Corporation, Pittsburgh, Pa.

[21] Appl. No.: 402,472

[22] Filed: Jul. 28, 1982

[51] Int. Cl.[3] ..... B05C 3/132; B60B 7/04

[52] U.S. Cl. ..... 118/420; 29/124; 29/132; 118/428

[58] Field of Search ..... 118/420, 428; 29/124, 29/132

[56] References Cited

U.S. PATENT DOCUMENTS 3,595,207 7/1971 Stricker ..... 118/420

4,056,873 11/1977 Cassard et al. ..... 29/132

FOREIGN PATENT DOCUMENTS 382442 7/1973 U.S.S.R. ..... 29/124

*Primary Examiner*—Evan K. Lawrence

*Attorney, Agent, or Firm*—Arthur J. Greif

[57] ABSTRACT

In the hot-dip coating of wire, a sinker assembly is utilized for guiding the wire during its travel through the molten metal bath. The outer perimeter or bearing surface around which the wire is wrapped is composed of alumina or other refractory segments housed within the sinker assembly. The discrete segments are provided with a small clearance to permit some movement, within the confines of the housing, along the locus of the wire travel. The outer surface of the discrete segments is grooved, so that the wire wrapped therearound bears solely on the internal sides of the groove.

8 Claims, 3 Drawing Figures

SINKER ASSEMBLY FOR HOT-DIP COATING APPLICATIONS

Figure 1:
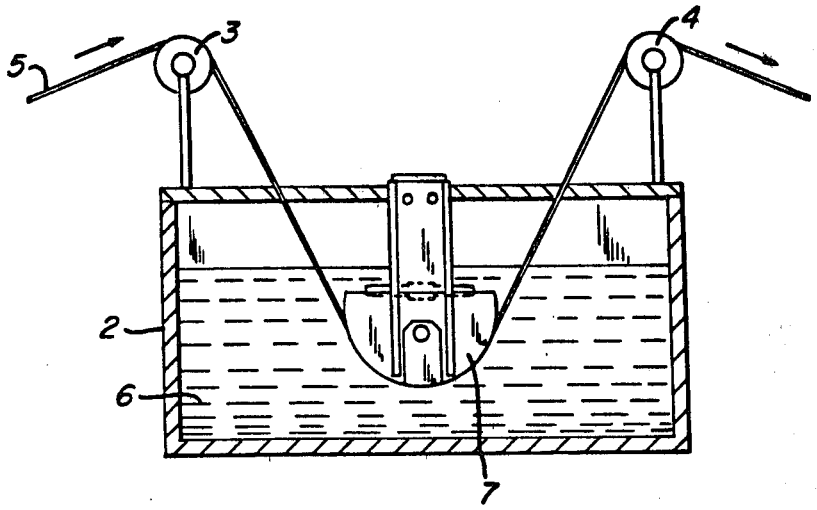

This invention relates to apparatus for the hot-dip coating of moving lengths of wire or rod products, and is more specifically directed to a stationary sinker assembly adapted to guide the wire during its travel through the molten coating bath, in which the surface along which the wire bears is composed of discrete refractory segments.

In the coating of moving lengths of wire through a liquid bath, means must necessarily be provided for directing the wire into and out of the bath, as well as for guiding and changing the direction of the wire during its travel in the bath. This is normally accomplished by a pulley arrangement known as a "sinker roll". In hot-dip coating wire with molten metals, such as zinc, aluminum, or combinations thereof, in view of the available materials for constructing requisite apparatus, difficulties are encountered in providing a sinker assembly, whether it be a stationary sinker or a rotating sinker roll, which can operate over extended periods of time within the high temperature molten metal. Desirably, the material of construction would exhibit tensile strengths normally possessed by metals, and the resistance to corrosion and chemical attack normally possessed by refractories, such as alumina, silicon carbide, etc. In the coating of wire products, the sinker is of critical importance since any significant degree of lateral movement or vibration will be reflected in variations of the resultant hot-dip coating. Rotating sinker rolls, with close tolerance bearings constructed from corrosion-resistant metals such as molybdenum, have been employed (e.g. U.S. Pat. No. 3,595,207). Although this type of sinker roll has been used with some success, it was found that with time, abrasive particles (dross) accumulates between the bearing surfaces causing excessive bearing wear, resulting in uneven passage of the wire. To overcome the problems resulting from rotating bearings, stationary sinkers have been employed, in which the wire merely slides around a bearing surface constructed from a metal alloy. However, the comparatively poor wear resistance of metals results in excessive wear by the sliding wire. To achieve enhanced wear resistance, solid refractory sinkers have also been tried. Although possessing excellent corrosion and wear properties, such stationary sinkers are very expensive and easily fractured due to thermal or mechanical stresses. To overcome these problems, the art has attempted to achieve a combination of the tensile properties of metals and the wear and corrosion resistance of refractories by coating the sliding surface of the metal with a refractory layer, see for example JA 53-25293, which discloses the coating of a sinker roll with a vitreous layer composed of components such as $SiO_2$, $Al_2O_3$, $Li_2O$, and MgO. Unfortunately, primarily as a result of the differences in thermal expansion between metal and refractory, such layers are redily chipped and flaked from the base metal. This invention is directed to the use of similar refractories, in which the problems of fracture are substantially overcome by employing discrete refractory segments arranged serially to provide an arcuate bearing surface for guiding the travel of the wire; wherein each segment (side-view) is in the form of a truncated, pie-shape cross-section.

Figure 2:
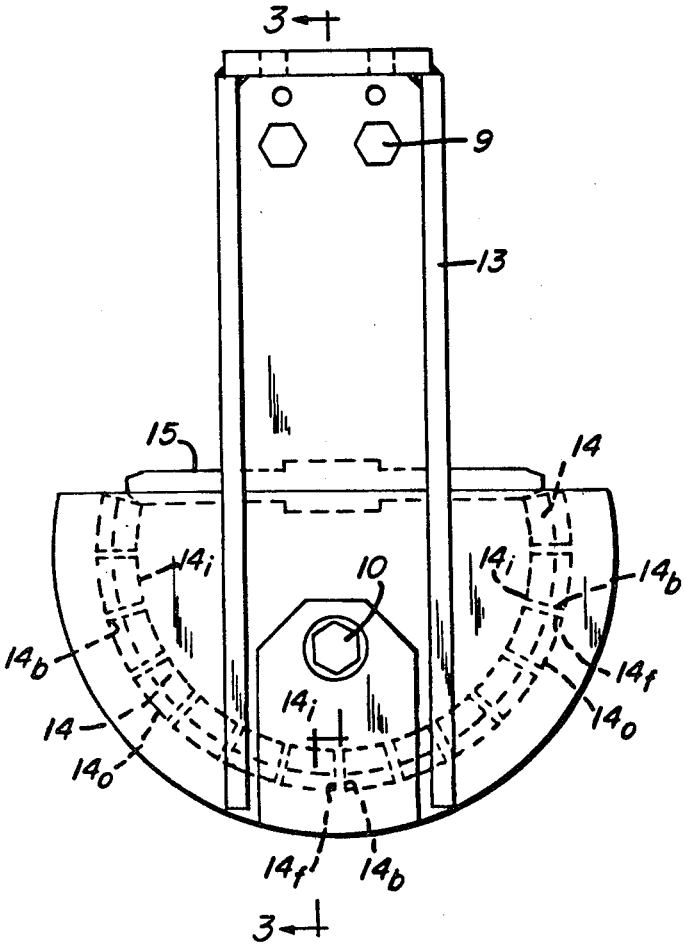
Figure 3:
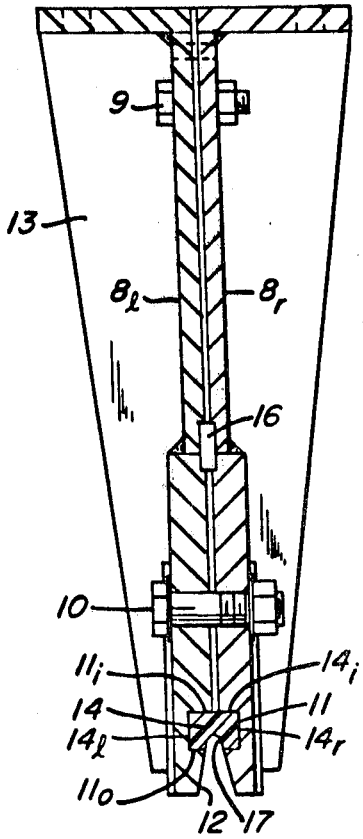

These and other advantages of the instant invention will be more apparent from a reading of the following description taken into conjunction with the appended claims and the drawings in which:

FIG. 1 is a side-view of the basic elements of a hot-dip coating apparatus utilizing a sinker assembly of this invention, FIG. 2 is an enlarged view of the sinker assembly portion of FIG. 1, and FIG. 3 is a front, sectional view of the sinker assembly portion of FIG. 2, as viewed from the direction of egress of wire from the coating bath.

Referring to FIG. 1, the hot-dip coating apparatus, includes a pot 2 for containing the molten metal, generally heated by an external source (not shown) to maintain the bath in molten condition. Mounted above the bath is an inlet pulley 3 and an outlet pulley 4, utilized respectively to direct the wire 5 downwardly into the bath 6 around sinker assembly 7 and again out of the bath.

Details of the sinker assembly 7 will be more evident by referring to FIGS. 2 and 3. The assembly consists of a frame member formed from two steel plates $\mathbf{8}_l$ and $\mathbf{8}_r$ fastened together by readily separable means, such as bolts 9 and 10. The lower portion of each plate, when viewed from the side, is arcuate in shape, e.g. semicircular as shown in FIG. 2. The lower portions contain a channel 11 and an inner taper 12, such that when the inner faces of the two plates are joined together, an annular chamber having a rectangular cross-section (FIG. 3) and an annular V-shape groove is provided. Gusset or support plates 13 may be provided for structural reinforcement. Refractory segments 14, composed of porcelain or ceramic materials resistant to the specific metal bath, are inserted into the channels 11 prior to joining the steel plates together. The segments are formed to conform to the contour of the annular chamber which serves as a housing preventing (with regard to FIG. 3) horizontal or vertical movement, and providing requisite stability during wire travel. Thus, the segments, as viewed from the side of the assembly (FIG. 2), are shaped in the form of a truncated pie, in which each segment has: two radial edges $\mathbf{14}_f$ and $\mathbf{14}_b$; an inner arcuate edge $\mathbf{14}_i$, mating in sliding relation with the inner arcuate peripheral surface $\mathbf{11}_i$ of channel 11; and an outer arcuate edge $\mathbf{14}_o$, mating with the outer arcuate peripheral surface $\mathbf{11}_o$ of channel 11. Analogously, the left and right surfaces of the segments, $\mathbf{14}_l$ and $\mathbf{14}_r$, respectively (FIG. 3), are formed to conform to the left and right sides of the annular chamber. After the requisite complement of ceramic segments is inserted into chamber 11, key plate 15 is inserted into opening 16. Desirably, the metallic portions of the sinker assembly exposed to the molten metal bath will be coated with molybdenum or other resistant material, to minimize the corrosion thereof.

Operation is initiated by stringing the wire within the grooves 17 of segments 14, which as shown in FIG. 3, are substantially semicircular and have a radius sufficiently large to accommodate the largest diameter wire to be coated. During operation of the coating line, the wire will be pulled up tightly in the groove and as a result wll be drawn around the sinker assembly causing the spaced segments to a self-align and become tightly packed for smoothest operation. As a result of such eventual tight packing, it is desirable that the front and back surfaces of the segments, i.e. radial edges $\mathbf{14}_f$ and $\mathbf{14}_b$, be ground or cast essentially flat, since the front surface of one segment will butt against the back surface of another and undue wear and misalignment would otherwise result. To provide for easy replacement of worn segments, for optimum stability and for enhanced resistance to thermal and mechanical shock, it is desirable that the mass of the segments be maintained within certain limits-primarily governed both by the length and height thereof, in which the ratio of height to length is desirably $<1$. Desirably, the length of each segment will be within the range $\frac{1}{2}$ to 5 inches, preferably $1\frac{1}{2}$ to 4 inches. In an assembly for the hot-dip galvanizing of wire at line speeds of up to 300 fpm, segments were employed having a length of $1\frac{3}{4}$ inches, measured between edges $\mathbf{14}_f$ and $\mathbf{14}_b$ along the edge $\mathbf{14}_o$; a height of $1\frac{1}{4}$ inches, measured between edges $\mathbf{14}_i$ and $\mathbf{14}_o$; and a width of $1\frac{1}{2}$ inches, measured between $\mathbf{14}_l$ and $\mathbf{14}_r$.

We claim:

1. A sinker assembly for guiding wire through a coating bath, comprising, a frame member, a lower portion of which has an arcuate peripheral surface;

a series of at least three truncated, pie-shape segments formed from a refractory material and shaped such that when the radial edges thereof are abutted against each other, they form a concentric annular belt encircling at least a major portion of said frame arcuate peripheral surface, the outer arcuate surfaces of said segments having a groove, said series of segments being arranged such that the grooves therein line up to form a circumferential axis for conducting wire therealong;

a housing, maintaining the inner arcuate surfaces of said segments in sliding contact with said farme arcuate peripheral surface and preventing lateral movement of the segments such that said circumferential groove axis is maintained in a substantially vertical plane through which said wire travels.

2. The sinker assembly of claim 1, in which the length of each of said segments, as measured along said circumferential axis, is within the range of $\frac{1}{2}$ to 5 inches.

3. The sinker assembly of claim 2, in which said frame comprises two plate members joined together in an easily separable manner, at least one of the plate surfaces facing each other in such joined relationship, having an annular channel therein such that such jointure of the plates forms an annular chamber which serves as said housing.

4. The sinker of claim 3, in which the circumferential length of said segments is $\frac{1}{2}$ to 4 inches, and said series comprises at least five such segments.

5. In an apparatus for the hot-dip coating of wire with molten metal, said apparatus including means (i) for containing said molten metal, (ii) for directing a moving length of such wire into and out of said molten metal, and (iii) a sinker assembly for guiding the wire during its travel through the molten metal, the improvement wherein said sinker assembly comprises, a frame member, a lower portion of which has an arcuate peripheral surface;

a series of at least three truncated, pie-shape segments formed from a refractory material and shaped such that when the radial edges thereof are abutted against each other, they form a concentric annular belt encircling at least a major portion of said frame arcuate peripheral surface, the outer arcuate surfaces of said segments having a groove, said series of segments being arranged such that the grooves therein line up to form a circumferential axis for conducting wire therealong;

a housing, maintaining the inner arcuate surfaces of said segments in sliding contact with said frame arcuate peripheral surface and preventing lateral movement of the segments such that said circumferential groove axis is maintained in a substantially vertical plane through which said wire travels.

6. The apparatus of claim 5, in which the length of each of said segments, as measured along said circumferential axis, is within the range $\frac{1}{2}$ to 5 inches.

7. The apparatus of claim 6, in which said frame comprises two plate members joined together in an easily separable manner, at least one of the plate surfaces facing each other in such joined relationship, having an annular channel therein such that such jointure of the plates forms an annular chamber, which serves as said housing.

8. The apparatus of claim 7, in which the circumferential length of said segments is $\frac{1}{2}$ to 4 inches, and said series comprises at least five such segments.

* * * * *